United States Patent [19]

Yoshikawa

[11] Patent Number: 4,624,222

[45] Date of Patent: Nov. 25, 1986

[54] INTAKE VALVE STRUCTURE FOR INTERNAL COMBUSTION ENGINE

[75] Inventor: Masaaki Yoshikawa, Iwata, Japan

[73] Assignee: Yamaha Hatsudoki Kabushiki Kaisha, Iwata, Japan

[21] Appl. No.: 721,577

[22] Filed: Apr. 10, 1985

[30] Foreign Application Priority Data

Apr. 11, 1984 [JP] Japan ..... 59-70952

[51] Int. Cl.[4] ..... F01L 1/26

[52] U.S. Cl. ..... 123/90.27; 123/90.23; 123/90.4

[58] Field of Search ..... 123/90.27, 90.4, 90.22, 123/90.23

[56] References Cited

U.S. PATENT DOCUMENTS

| | | | |
|---|---|---|---|
| 1,301,007 | 4/1919 | Roof | 123/90.4 |
| 1,415,167 | 5/1922 | Fuchs | 123/90.4 |
| 3,139,870 | 7/1964 | Sampietro | 123/90.27 |

FOREIGN PATENT DOCUMENTS

| | | | |
|---|---|---|---|
| 186009 | 11/1982 | Japan | 123/90.27 |
| 296125 | 8/1928 | United Kingdom | 123/90.27 |

*Primary Examiner*—Ira S. Lazarus

*Attorney, Agent, or Firm*—Ernest A. Beutler

[57] ABSTRACT

Several embodiments of valve arrangements for internal combustion engines that permit the use of three intake valves per cylinder while maintaining a small clearance volume and minimum surface area for the cylinder head. This is accomplished by positioning two of the valves so that their axes are inclined at a different angle to the line of reciprocation of the piston and which axes define a plane that intersects the axis of reciprocation of the remaining intake valve and which is positioned at a lesser angle to the axis of reciprocation. The head of the third valve is disposed at a lesser distance from the line of intersection than the heads of the other two valves so as to achieve the desired compactness. In some embodiments of the invention, the valves are operated directly and in others they are operated via rocker arms. In addition, a rocker arm arrangement is provided that permits the use of five valves per cylinder actuated by a single centrally positioned camshaft while still affording the possibility of a central spark plug location and easy servicing of the spark plug.

16 Claims, 12 Drawing Figures

INTAKE VALVE STRUCTURE FOR INTERNAL COMBUSTION ENGINE

BACKGROUND OF THE INVENTION

This invention relates to a intake valve structure for an internal combustion engine and more particularly to an improved valve placement arrangement and valve actuating mechanism.

It is well known that the specific output of an internal combustion engine can be increased by using plural valves for each combustion chamber. For this reason, the use of four valves per cylinder is widely becoming adopted, particularly in high performance engines. Still further increases can be enjoyed by utilizing more than four valves per cylinder. However, there is a practical limit to the number of valves that can be used in a given cylinder which is determined by the valve placement, valve actuating mechanism and combustion chamber configuration. With conventional valve placement, the increased number of valves gives rise to a combustion chamber configuration that prevents an undesirably high surface area and which also increases the clearance volume so that high compression ratios are not possible. As a result, the previously proposed valve placements have practically limited the number of valves per cylinder to four.

It is, therefore, a principal object of this invention to provide an improved valve placement arrangement for an internal combustion engine that permits the use of more than four valves per cylinder.

It is another object of this invention to provide a valve placement system for an internal combustion engine that permits high compression ratios and small combustion chamber surface areas.

In addition to the geometric configurations discussed above, the use of plural valves for a single combustion chamber also can give rise to problems in connection with spark plug placement and accessibility. If four or more valves are used for a given combustion chamber, it has been difficult with previously proposed arrangements to operate all of the valves from a single camshaft and still permit the use of a single centrally positioned spark plug. As a result, it has been necessary to resort to the use of two or more camshafts for operating the valves and this gives rise to complexity of the engine and increased cost.

It is, therefore, a still further object of this invention to provide an improved valve actuating mechanism for an internal combustion engine that will permit a central spark plug placement and which will permit the use of only a single camshaft for operating all valves.

SUMMARY OF THE INVENTION

A first feature of this invention is adapted to be embodied in a valve arrangement for an internal combustion engine comprising at least three poppet type valves having head portions adapted to control the flow through respective ports serving the same combustion chamber and wherein the combustion chamber is defined in part by a reciprocating piston. Each of the valves has a respective stem portion that supports the valve for reciprocation along a respective axis. The axes of reciprocation of the valves are disposed to intersect at a common line when viewed in a plane containing the axis of reciprocation of one of the valves which line is perpendicular to the plane. At least one of the axes is disposed at a lesser angle to the line of reciprocation of the piston than the other of the axes. The head of the lesser angled valve lies at a lesser distance from the line of intersection than the head of another of the valves when the valves are closed.

Another feature of the invention is adapted to be embodied in an internal combustion engine having a cylinder supporting a piston for reciprocation and a cylinder head affixed relative to and closing the cylinder. At least three poppet valves are supported for reciprocation about respective axes by the cylinder head on one side of a plane containing the axis of the cylinder. At least two poppet valves are supported for reciprocation by the cylinder head along axes that lie on the other side of the plane. A spark plug is carried by the cylinder head and has its gap disposed contiguous to the cylinder axis. A camshaft is supported for rotation about a camshaft axis that is disposed substantially in the plane and has first and second cam lobes formed thereon that are spaced on the same side of the cylinder axis. A first rocker arm has a follower portion engaged with the first cam lobe and at least three finger portions engaged with the at least three poppet valves for operating the three poppet valves on rotation of the camshaft. A second rocker arm is provided that has a follower portion that is engaged with the second cam lobe and finger portions that are engaged with the at least two poppet valves for operating the at least two poppet valves.

DETAILED DESCRIPTION OF THE PREFERRED EMBODIMENTS

Embodiment of FIGS. 1 Through 5

Figure 1:
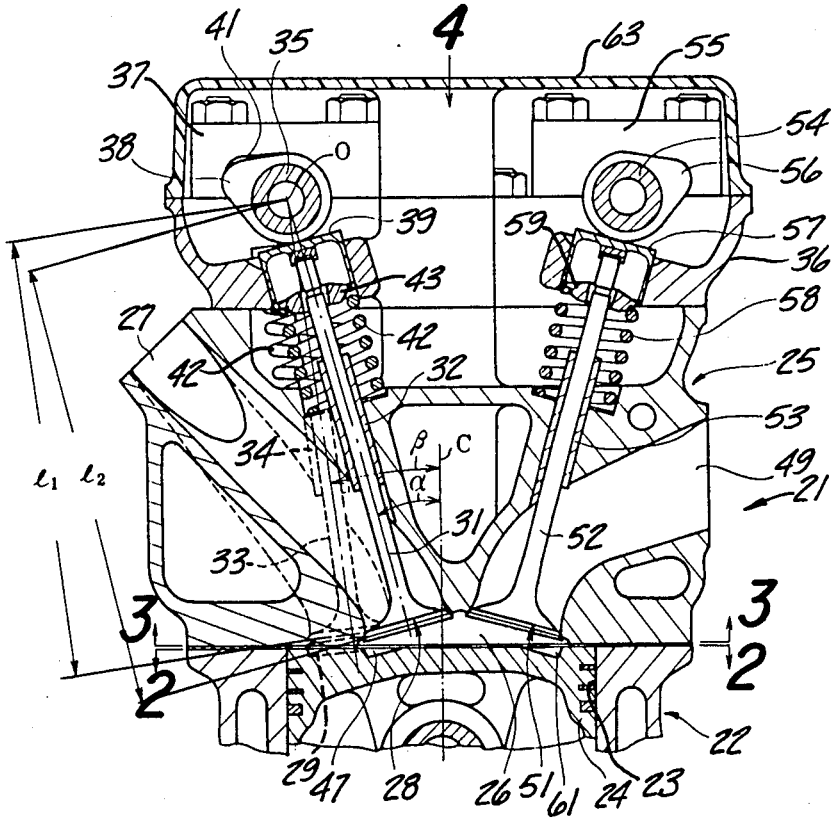
FIG. 1 is a cross-sectional view taken through a cylinder of an internal combustion engine constructed in accordance with a first embodiment of the invention.

In FIGS. 1 through 5, the reference numeral 21 indicates generally an inline internal combustion engine constructed in accordance with a first embodiment of the invention. Although all embodiments of the invention are described in conjunction with only a single cylinder of the engine, it should be readily apparent that this invention is adapted to be employed with engines of any number of cylinders and other configurations such as V type, etc. Since the invention is directed primarily toward the valve train and combustion chamber configuration, only this portion of the engine has been illustrated in detail, and for the same reason, only the construction associated wtih one of the cylinders in each embodiment will be described.

The engine 21 includes a cylinder block 22 that is formed with cylinder bores 23. Pistons 24 are supported for reciprocation in the cylinder bores 13 and drive the crankshaft (not shown) in a known manner. A cylinder head assembly 25 is affixed to the cylinder block 22 in a known manner. The cylinder head 25 is formed with individual cavities 26 that cooperate with the cylinder bores 23 and respective pistons 24. At times, the cavities 26 will be referred to as the combustion chamber.

The cylinder head 25 is formed with intake passages 27 that communicate with each combustion chamber 26. The intake passages 27 may be either a plurality of separate intake passages or may comprise a single intake passage that branches into three separate passages that terminate in respective intake ports. Valve seats (not shown) are pressed into the cylinder head 25 and define the termination of the individual intake ports. Two of the intake ports are disposed closer to a plane perpendicular to FIG. 1 and containing the axis of the cylinder bore 23, which plane is identified by the dot-dash line C. The remaining intake port is disposed between these two first mentioned intake ports and is spaced farther from the plane C. The configuration may be best seen in FIG. 3.

Intake valves 28 cooperate with valve seats formed in the first two mentioned intake ports so as to control the flow of intake charge into the combustion chamber 26. An intake valve 29 cooperates with a valve seat formed at the remaining intake port. The intake valves 28 reciprocate along respective parallel axes defined by their stems 31. The stems 31 of the intake valves 28 are supported for reciprocation along these axes by valve guides 32 that are pressed into the cylinder head 25. The intake valve 29 for each cylinder 23 reciprocates along an axis as defined by its stem 33 supported in a valve guide 34 that is also pressed into the cylinder head 25. The axis of the valve 29 is not parallel to the axes of the valves 28 for a reason to be described.

The axes of the valves 28 and 29 all intersect the axis of rotation O of an intake camshaft, indicated generally by the reference numeral 35. The intake camshaft 35 is supported for rotation in a cam tower 36 that is affixed to the cylinder head 25 in a known manner. Bearing caps 37 are affixed at spaced locations to the cam tower 36 and cooperate with the cam tower to journal the intake camshaft 35.

Because the intake valve axes intersect the axis of rotation O of the camshaft 35, it is possible to directly operate each of the intake valves 28 and 29. The camshaft 35 is provided with a first pair of lobes 38 that engage tappet followers 39 that are reciprocally supported in the cam tower 36 and which contact the stems of the intake valves 28 for their direct actuation. The camshaft 35 is also provided with a lobe 41 between the lobes 38 which lobe 41 cooperates with a tappet follower 39 for directly actuating the intake valve 29.

Valve springs 42 encircle each of the intake valves 28 and 29 and act against keeper spring retainer assemblies 43 for urging the valves 28 and 29 to their closed positions.

The reciprocal axes of the intake valves 28 lie at an angle $\alpha$ to the plane C (FIG. 1). The axis of the intake valve 29 lies at an angle $\beta$ to the plane C. The angle $\alpha$ is greater than the angle $\beta$. That is, the axes of the intake valves 28 are at a greater angle to the cylinder bore axis than is the axis associated with the intake valve 29. As a result, the intake valve 29 is spaced radially outwardly from the plane C toward the peripheral edge of the cylinder bore 23, as clearly shown in FIG. 3. This arrangement permits the three intake valves 28, 29 all to reciprocate between their open and closed positions without interference with each other, while at the same time maximizing intake valve area. Due to this different angle relative to the camshaft rotational axis O, the cam lobe 41 is advanced relative to the cam lobes 38 so that all intake valves 28 and 29 will be operated simultaneously. Of course, if desired, a different valve timing might be employed. Since the axes of the valves 28 and 29 all intersect the camshaft axis O, it is possible to operate more than two intake valves from the same camshaft.

Figure 3:
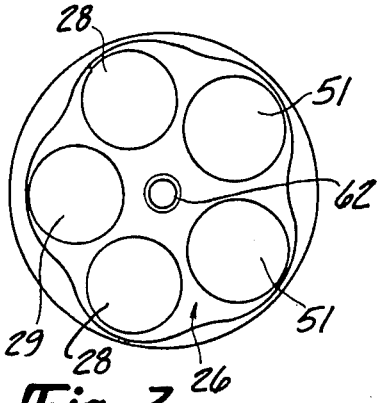
FIG. 3 is a view taken in the direction of the line 3—3 of FIG. 1 and shows the configuration of the combustion chamber as formed in the cylinder head.
Figure 4:
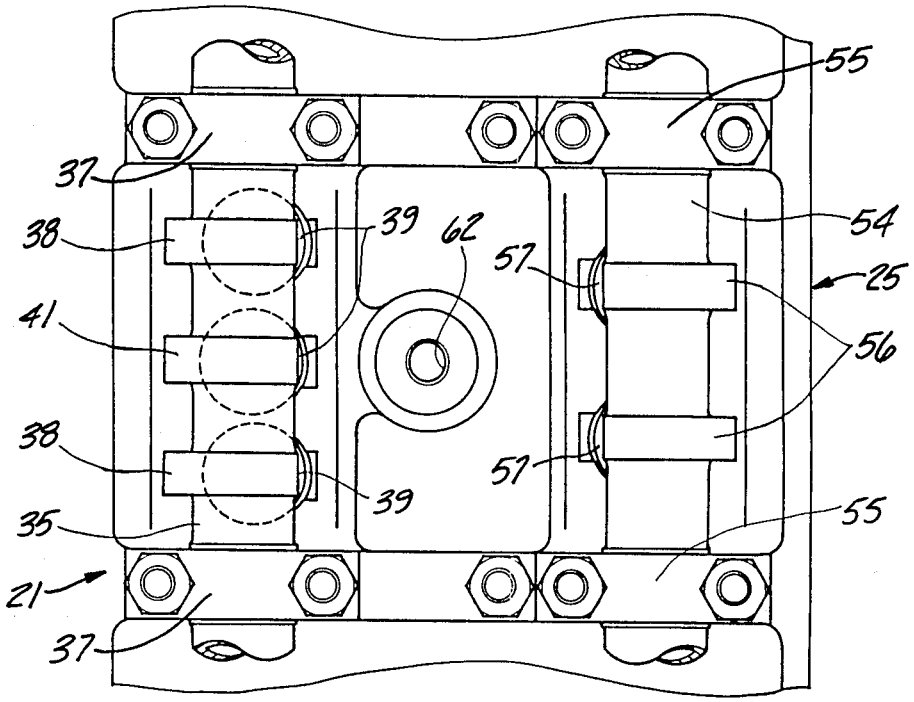
FIG. 4 is a top plan view of the cylinder head, with camshaft cover removed, looking in the direction of the arrow 4 in FIG. 1.
Figure 5:
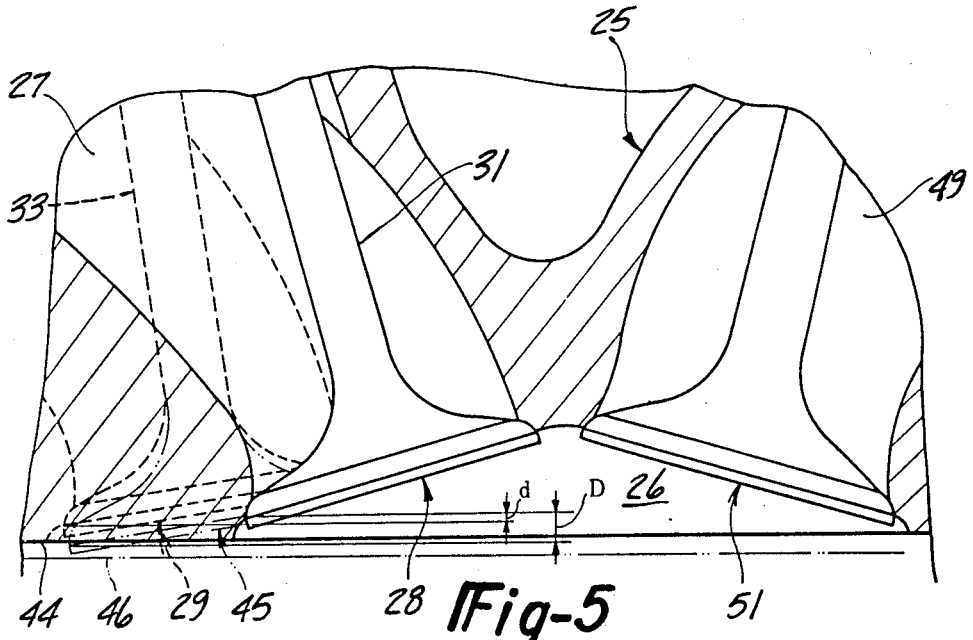
FIG. 5 is an enlarged view of the valve area taken along the same plane as FIG. 1.

In addition to providing a maximum valve area within the combustion chamber 26, it is also important to position the heads of the intake valves 28 and 29 in such a manner as to minimize the surface area of the combustion chamber 26 and also so as to minimize the clearance volume of the engine. One way this is done is by having the length $l_2$ between the heads of the intake valves 28 and the camshaft rotational axis O grater than the corresponding distance $l_1$ between the head of the intake valve 29 and the camshaft rotational axis O. FIG. 3 shows the effect of doing this. In this figure, the position of the valve 29 and specifically its head in relation to a bottom face 44 of the cylinder head is depicted. If the distance $l_1$ was made equal to the distance $l_2$, the head of the intake valve 29 would lie at the point as shown by the phantom line view 45 and it, therefore, would be necessary to lower the cylinder head surface 44 to the phantom line position 46. As seen in FIG. 5, the distance d from the lower edge of the valve seat of the intake valves 28 to the valve seat of the intake valves 29 is relatively shallow. However, the distance D would be substantially increased if the lengths $l_1$ and $l_2$ were made equal. The significance of this is that the unequal and lesser length $l_1$ than $l_2$ permits a substantially lower or reduced clearance volume than would be possible if the lengths were equal.

As is normal with high compression engine practice, the head of the piston 24 is provided with a pair of recesses 47 to clear the intake valves 28 and a recess 48 to clear the intake valve 29.

Exhaust passages 49 extend through the side of the cylinder head 25 opposite to the intake passages 27. There are a pair of exhaust passages 49 associated with each cylinder bore 23 in connection with this embodiment. The exhaust passages 49 terminate in exhaust ports and valve seats. Exhaust valves 51 cooperate with the valve seats and exhaust ports for controlling the communication of the combustion chamber 26 with exhaust passages 49. The exhaust valves 51 are supported for reciprocation about respective axes defined by their stems 52 that cooperate with valve guides 53 pressed into the cylinder head 25.

The exhaust valve axes intersect the axis of rotation of an exhaust camshaft 54. The exhaust camshaft 54 is rotatably journaled in the cam tower 36 and is journaled by the cam tower 36 and bearing caps 55 that are affixed in a known manner to the cam tower 36. The exhaust camshaft 54 is provided with lobes 56 that engage tappet followers 57 which, in turn, directly actuate the exhaust valves 51.

Valve springs 58 encircle the exhaust valves 36 and engage keeper spring retainer assemblies 59 for urging the exhaust valves 51 to their closed position.

Figure 2:
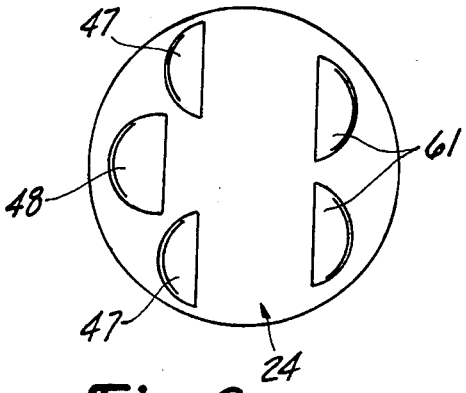
FIG. 2 is a view taken in the direction of the line 2—2 of FIG. 1 and shows the head of the piston.

As may be readily seen from FIG. 3, the centers of the exhaust valves 51 lie on a plane that is offset from the plane C on the side opposite the intake valves 28 and 29. A portion of the heads of the valves 28 also extend across the plane C. The piston 24 is formed with recesses 61 in its head to clear the heads of the valves 51 (FIG. 2).

A threaded spark plug opening 62 is formed in the cylinder head substantially on the plane C and at the center of the respective cylinder bore 23 to receive a spark plug with its gap at that point.

A camshaft cover 63 is affixed in any suitable manner to the cam tower 36 so as to enclose the camshafts 35 and 54. The cover 63 is formed with suitable openings that are aligned with the spark plug openings 62 to permit insertion and removal of the spark plugs.

Figure 6:
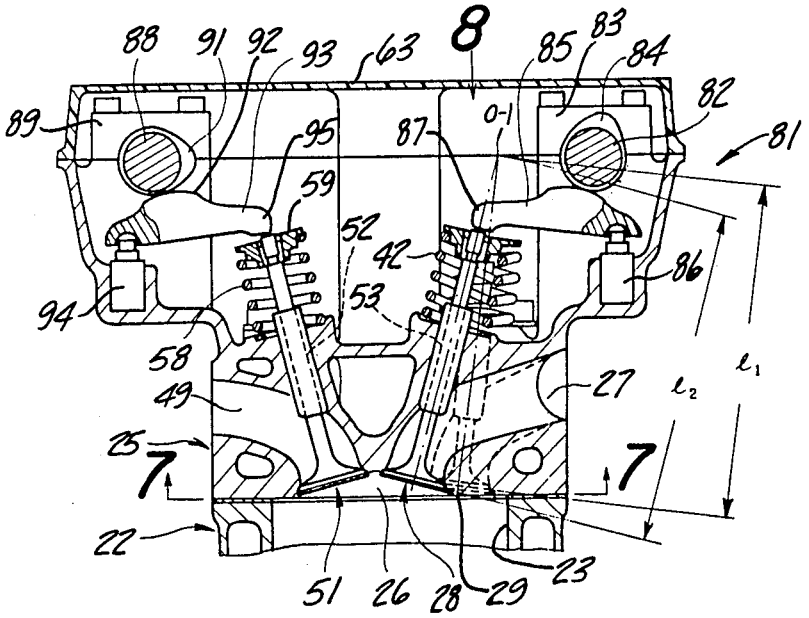
FIG. 6 is a cross-sectional view, in part similar to FIG. 1, showing another embodiment of the invention.
Figure 7:
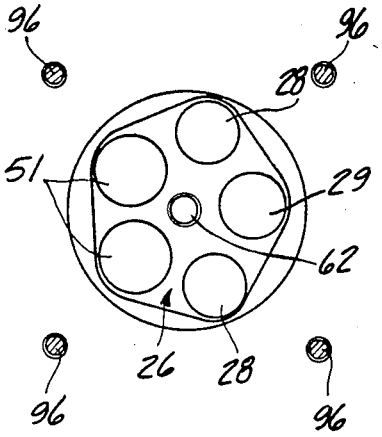
FIG. 7 is a view taken in the direction of the line 7—7 of FIG. 6 and shows the configuration of the combustion chamber formed in the cylinder head.
Figure 8:
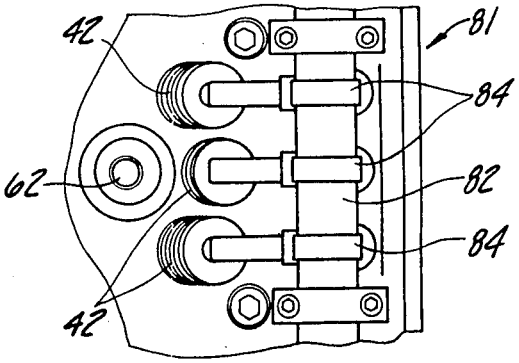
FIG. 8 is a view looking in the direction of the arrow 8 in FIG. 6.
Figure 9:
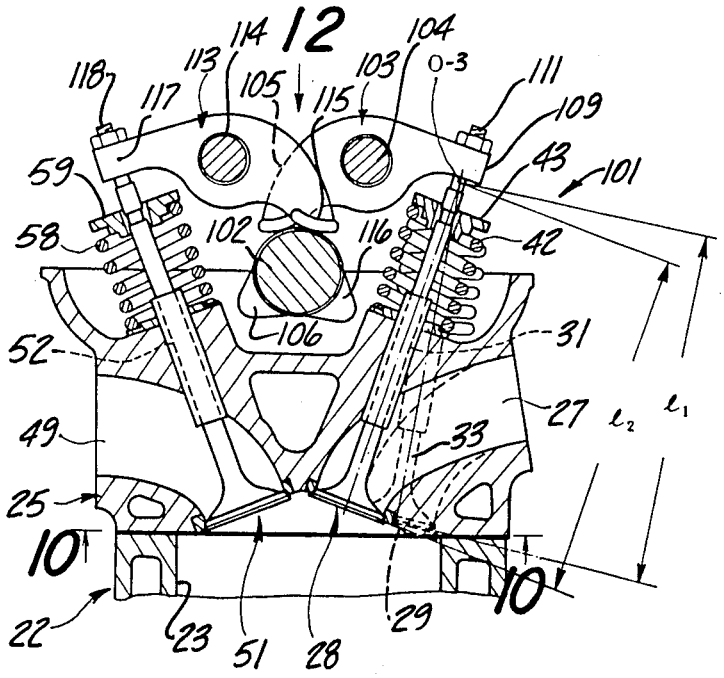
FIG. 9 is a cross-sectional view, in part similar to FIGS. 1 and 6, showing a still further embodiment of the invention.
Figure 10:
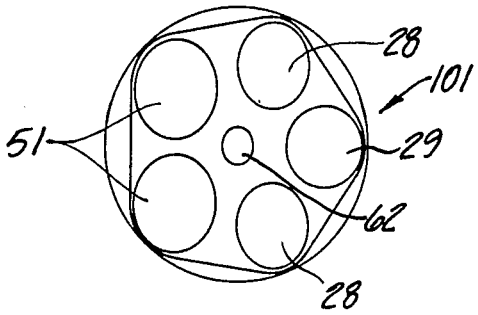
FIG. 10 is a view taken along the line 10—10 of FIG. 9 and shows the configuration of the combustion chamber in the cylinder head.
Figure 11:
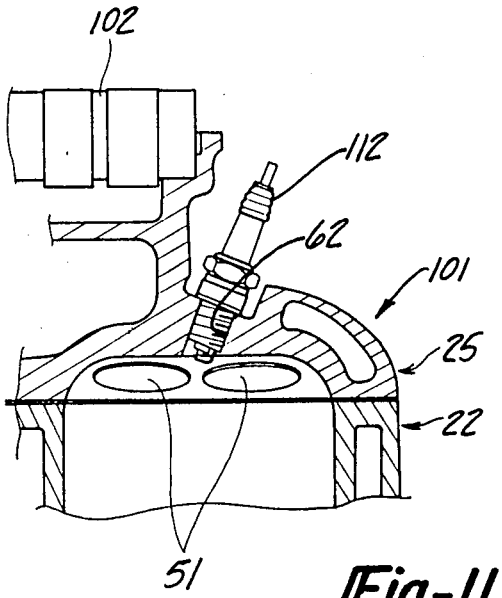
FIG. 11 is a cross-sectional view taken along the line 11—11 of FIG. 12.
Figure 12:
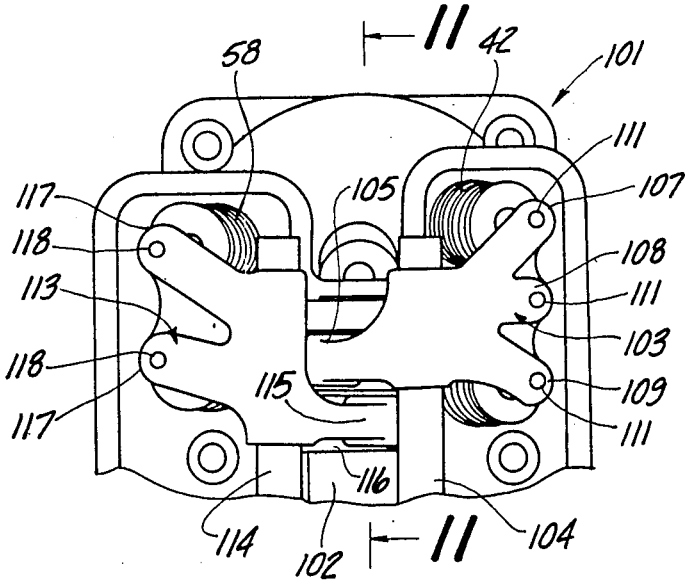
FIG. 12 is a top plan view taken in the direction of the arrow 12 in FIG. 9.

Embodiment of FIGS. 6 Through 8

An engine constructed in accordance with a second embodiment of this invention is identified generally by the reference numeral 81. The engine 81 has its intake and exhaust valves and intake and exhaust ports arranged as in the embodiment of FIGS. 1 through 5. Thus, these components have been identified by the same reference numerals and a detailed description of similar components will not be repeated. This embodiment differs from the embodiment of FIGS. 1 through 5 in that the intake and exhaust valves 28, 29 and 52 are not directly actuated by the camshafts. Rather, the valves 28, 29 and 52 are operated by rocker followers, as will be described.

The axes of reciprocation of the intake valves 28 are, as in the previously described embodiment, parallel to each other and lie at an angle to a plane passing through the axis of the cylinder bore 23 as in the previously described embodiment. The axis of reciprocation of the intake valve 29 lies at lesser angle to this plane, also as in the previously described embodiment. As in the previously described embodiment, the axes of the valves 28 and 29 all intersect along a line at a point O-1. However, in this embodiment, the line of intersection is not coincident with the axis of rotation of the actuating camshaft. Rather, in this embodiment, the axes of reciprocation intersect along the line O-1 which generally lies along the center portion of the stems of the valves 28 and 29 when these valves are in their closed positions.

In this embodiment, an intake camshaft 82 is rotatably supported directly in the cylinder head 25 by means of bearings formed in the cylinder head 25 and bearing caps 83 that are affixed to the cylinder head 25. The intake camshaft 82 has lobes 84 for operating the intake valves 28 and 29 associated with each cylinder bore 23. In this embodiment, the axis of rotation of the camshaft 82 is disposed outwardly relative to the line O-1 of intersection of the axes of reciprocation of the valves 28 and 29.

Rocker arms, identified generally by the reference numeral 85 are provided for each valve and are journaled in the cylinder head 84 on respective hydraulic adjusting pivots 86. Each rocker arm 85 has a finger portion 87 for coaction with the respective valve 28, 29 so to transmit pivotal movement of the rocker arm 85 into reciprocation of the respective intake valves.

For the reasons as discussed in conjunction with the embodiment of FIGS. 1 through 5, the length of the intake valves 28 from their heads to the line of intersection O-1 of the valve reciprocation axes ($l_2$) is greater than the corresponding length $l_1$ between the head of the valve 29 and the line O-1. The geometric relationships as described in conjunction with FIG. 5 apply equally as well to this embodiment and for that reason they will not be repeated.

The exhaust valves 51 are operated in a similar manner to the intake valves 28 and 29. That is, an exhaust camshaft 88 is rotatably journaled in the cylinder head assembly 25 by means of integral bearing surfaces formed in it and by bearing caps 89 that are fixed to the cylinder head assembly 25. The exhaust camshaft 88 has lobes 91 for each of the exhaust valves 51 and these lobes engage follower portions 92 on rocker arms 93. The rocker arms 93 are pivotally supported on the cylinder head assembly 25 by means of hydraulically actuating lash adjusters 94 at one end. The opposite ends of the rocker arms 93 are formed with finger portions 95 that cooperates with the exhaust valve stems for operating these valves upon rotation of the exhaust camshaft 88.

FIG. 7 illustrates the manner in which the cylinder head 25 is affixed to the cylinder block 22 and this includes studs 96 that are threaded into the cylinder block and which cooperate with nuts for affixing the head 25 to the block 22 in a generally known manner.

Embodiment of FIGS. 9 Through 12

An internal combustion engine constructed in accordance with a still further embodiment of the invention is identified generally by the reference numeral 101. The engine 101 has a cylinder block, cylinder head and valve placement construction substantially the same as the previously described embodiments and, for that reason, these components have been identified by the same reference numerals and will not be described again in detail. The engine 101, like the embodiment of FIGS. 6 through 8, employs rocker arms for operating the intake valves 28 and 29 and exhaust valves 51. Unlike the preceding embodiment, however, this embodiment employs a single camshaft for operating all of the valves. As such, the camshaft is centrally located over the cylinder head 25 and, therefore, a novel valve operating rocker arm arrangement is employed so as to permit the central placement of the spark plug opening 62 without interference from the camshaft.

Referring now in detail particularly to FIGS. 9 through 12, the engine 101 is provided with a single centrally positioned camshaft 102 that is located substantially on the aforedescribed center plane of the axis of the cylinder bores 23. A first, intake rocker arm, indicated generally by the reference numeral 103 has an intermediate portion that is journaled on the cylinder head assembly 25 by an intake rocker arm shaft 104. The rocker arm 103 has a follower portion 105 that is offset to one side of the axis of the cylinder bore 23 and which is engaged with an offset cam lobe 106 of the camshaft 102. The opposite end of the rocker arm 103 has three respective finger portions 107, 108 and 109 each of which carries a respective adjusting screw 111. The screws 111 associated with the finger portions 107 engage the stems of the valves 28 for actuating them. The adjuster screw 111 of the finger portion 108 engages the stem of the intake valve 29 for actuating it. In this way, all three intake valves 28 and 29 will be operated in unison by a single rocker arm 103. The offset portion of the finger follower 105 and the cam lobe 106 permits the central position of the spark plug opening 62 and permits a spark plug 112 received therein to be conveniently installed and removed.

In a similar manner, an exhaust rocker arm assembly 113 has an intermediate portion that is journaled by an exhaust rocker arm shaft 114 that is carried by the cylinder head assembly 25 on the side opposite to the intake rocker 104 in relation to the camshaft 106. The exhaust rocker arm 113 has an offset follower portion 115 that is axially spaced from the cylinder bore axis farther than the follower portion 105 of the intake rocker arm. The exhaust rocker arm follower portion 115 cooperates with an exhaust cam lobe 116 of the camshaft 102, which lobe is axially offset from the intake lobe 106. On the opposite side of the rocker arm shaft 114, the rocker arm has a pair of finger portions 117 each of which carries an adjusting screw 118 for engagement with the stems of the exhaust valves 51 for operating them in unison. Again, the offset of the construction facilitates the central positioning of the spark plug 112 and its removal without interference from the single camshaft and its actuating mechanism.

As with the previously described embodiments, the axes of reciprocation of the intake valves 28 and 29 all intersect at a line O-3 and in this embodiment this line is coincident with the point of engagement with the adjusting screws 111. The length $l_1$ of the intake valve 29 from its head to the intersection with the line O-3 is less than the corresponding dimension $l_2$ of the intake valves 28 for the reasons as previously described.

It should be readily apparent from the foregoing description that a number of embodiments of the invention have been described that permit the use of multiple valves for a single combustion chamber of an internal combustion engine while maintaining a small clearance volume and minimum surface area to volume ratio. Although the invention has been described in conjunction with the use of three intake valves and two exhaust valves, the same features could be true with the use of more than two exhaust valves provided the same geometric relationship as described was met. Also, there has been described an improved arrangement wherein this geometry can be practiced with the use of a single driving overhead camshaft.

Although a number of embodiments of the invention have been illustrated and described, still other variations may be made without departing from the spirit and scope of the invention, as defined by the appended claims.

I claim:

1. A valve arrangement for an internal combustion engine comprising at least three poppet type valves having head portions adapted to control the flow through respective ports serving the same combustion chamber which combustion chamber is defined in part by a reciprocating piston, each of said valves having a respective stem portion for supporting said valves for reciprocation along respective axes, said axes being disposed to intersect at a common line when viewed in a plane containing the axis of a respective one of said valves which line is perpendicular to said plane, at least one of said axes being disposed at a lesser angle to the line of reciprocation of said piston than the other of said axes, the head of said lesser angled valve lying at a lesser distance from the line of intersection than the head of another of said valves when said valves are closed.

2. A valve arrangement as set forth in claim 1 wherein the valves and ports all serve the same function for the cylinder.

3. A valve arrangement as set forth in claim 1 further including cam means for actuating all of the valves.

4. A valve arrangement as set forth in claim 3 wherein the cam means are all carried by the same camshaft.

5. A valve arrangement as set forth in claim 4 wherein the cam means directly actuate the valves.

6. A valve arrangement as set forth in claim 4 wherein the cam means operate the valves through rocker arm means.

7. A valve arrangement as set forth in claim 1 wherein the three valves are positioned on one side of a plane containing the axis of reciprocation of the piston and perpendicular to the first mentioned plane and further including a pair of valves disposed on the opposite side of the plane from the first mentioned valves.

8. A valve arrangement as set forth in claim 7 wherein the first mentioned valves and ports all serve the same function for the cylinder.

9. A valve arrangement as set forth in claim 7 further including cam means for actuating all of the valves.

10. A valve arrangement as set forth in claim 9 wherein the cam means are all carried by the camshaft means.

11. A valve arrangement as set forth in claim 10 wherein the cam means directly actuate the valves and there is one camshaft for the first mentioned valves and another camshaft for the other valves.

12. A valve arrangement as set forth in claim 10 wherein the cam means operate the valves through rocker arm means.

13. A valve arrangement as set forth in claim 11 further including a cylinder head closing the cylinder bore and supporting the valves.

14. A valve arrangement as set forth in claim 12 further including a cylinder head closing the cylinder bore and supporting the valves.

15. A valve arrangement as set forth in claim 14 wherein a single rocker arm operates all of the first mentioned valves and a single rocker arm cooperable with the same camshaft operates the second mentioned valves.

16. An internal combustion engine having a cylinder supporting a piston for reciprocation, a cylinder head affixed relative to and closing said cylinder, at least three poppet valves supported for reciprocation about respective axes by said cylinder head on one side of a plane containing the axis of said cylinder, at least two poppet type valves supported for reciprocation by said cylinder head along axes lying on the other side of said plane, a spark plug carried by said cylinder head and having its gap disposed contiguous to said cylinder axis, a camshaft supported for rotation about a camshaft axis disposed substantially in said plane and having first and second cam lobes formed thereon spaced on the same side of said cylinder axis, a first rocker arm having a follower engaged with said first cam lobe and having three finger portions each engaged with a respective one of the three poppet valves for operating the three poppet valves simultaneously, and a second rocker arm having a follower engaged with said second cam lobe and a pair of finger portions each engaged with a respective one of the two poppet valves for operating the two poppet valves simultaneously.

* * * * *